US010146168B2

(12) United States Patent
Horiuchi

(10) Patent No.: US 10,146,168 B2
(45) Date of Patent: Dec. 4, 2018

(54) BELT CLEANING DEVICE, IMAGE FORMING APPARATUS

(71) Applicant: KYOCERA Document Solutions Inc., Osaka-shi, Osaka (JP)

(72) Inventor: Yoshinori Horiuchi, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/861,545

(22) Filed: Jan. 3, 2018

(65) Prior Publication Data

US 2018/0239296 A1 Aug. 23, 2018

(30) Foreign Application Priority Data

Feb. 20, 2017 (JP) ..... 2017-028985

(51) Int. Cl.
*G03G 21/00* (2006.01)
*G03G 21/10* (2006.01)
*G03G 15/16* (2006.01)

(52) U.S. Cl.
CPC ..... *G03G 21/0011* (2013.01); *G03G 15/161* (2013.01); *G03G 21/105* (2013.01); *G03G 21/0035* (2013.01); *G03G 21/0047* (2013.01); *G03G 2215/1661* (2013.01)

(58) Field of Classification Search
CPC ..... G03G 21/0011; G03G 21/0035; G03G 21/0047; G03G 21/105; G03G 15/161; G03G 2215/1661; G03G 15/168
See application file for complete search history.

(56) References Cited

U.S. PATENT DOCUMENTS

2014/0153957 A1* 6/2014 Yonemoto ..... G03G 15/161 399/101
2014/0241751 A1* 8/2014 Morishita ..... G03G 15/161 399/101
2014/0294432 A1* 10/2014 Yonemoto ..... G03G 15/161 399/101
2016/0085202 A1* 3/2016 Oba ..... G03G 21/0011 399/102
2016/0132015 A1* 5/2016 Uno ..... G03G 15/0136 399/71

FOREIGN PATENT DOCUMENTS

JP 2014142578 A 8/2014

* cited by examiner

*Primary Examiner* — Sandra Brase
(74) *Attorney, Agent, or Firm* — Alleman Hall Creasman & Tuttle LLP

(57) ABSTRACT

In a belt cleaning device, a pivot member supports a first rotation shaft of a cleaning roller in a rotatable manner, and is supported by a second rotation shaft of a collection roller. An elastic member keeps the cleaning roller contact with an endless belt at a position. A first seal portion, fixed to the pivot member, is in contact with the collection roller. A housing has a first space storing the cleaning roller and the collection roller, and a second space storing waste toner rubbed off from the collection roller by a blade. The housing supports the second rotation shaft. The second seal portion is fixed to one of an inner surface of the housing and the pivot member, and is in contact with the other. The blade, the first seal portion, and the second seal portion partition the housing into the first space and the second space.

5 Claims, 4 Drawing Sheets

BELT CLEANING DEVICE, IMAGE FORMING APPARATUS

INCORPORATION BY REFERENCE

This application is based upon and claims the benefit of priority from the corresponding Japanese Patent Application No. 2017-028985 filed on Feb. 20, 2017, the entire contents of which are incorporated herein by reference.

BACKGROUND

The present disclosure relates to a belt cleaning device and an image forming apparatus including the same.

In general, a tandem-type image forming apparatus includes an intermediate transfer belt and a belt cleaning device. The intermediate transfer belt is an endless belt to which toner images are transferred from a plurality of image carriers, and the endless belt carries the toner images to a transfer position where it comes into contact with a sheet.

The endless belt is supported by a pair of belt support rollers. The endless belt is stretched over the pair of belt support rollers, and is rotated as one of the pair of belt support rollers is rotated. The belt cleaning device removes waste toner from the intermediate transfer belt.

The image forming apparatus may include a belt deforming mechanism that deforms the intermediate transfer belt. The belt deforming mechanism deforms the intermediate transfer belt to a color image transfer shape and a monochrome image transfer shape, wherein in the color image transfer shape, the intermediate transfer belt is in contact with all of the plurality of image carriers, and in the monochrome image transfer shape, the intermediate transfer belt is in contact with only one image carrier that carries a black toner image. In this case, one of the pair of belt support rollers is a displaceable roller that is supported so as to be displaced in response to a change of the intermediate transfer belt in shape.

The belt cleaning device includes a cleaning roller and a housing, wherein the cleaning roller collects the waste toner from the intermediate transfer belt, and the housing stores the collected waste toner. The cleaning roller rotates while in contact with the intermediate transfer belt. Furthermore, the belt cleaning device includes a seal member that prevents the waste toner from leaking from the housing.

For example, there is known a belt cleaning device that includes a sheet-like seal member that is attached to an edge portion of an opening of the housing. In this case, the seal member comes into contact with the intermediate transfer belt, and closes a gap between the housing and the intermediate transfer belt.

The intermediate transfer belt slightly vibrates while operating. As a result, when the seal member is in contact with the intermediate transfer belt, the seal member also vibrates. This configuration produces an advantageous effect that powder such as paper dust is prevented from adhering to the seal member.

SUMMARY

A belt cleaning device according to an aspect of the present disclosure includes a cleaning roller, a collection roller, a blade, a housing, a pivot member, an elastic member, a first seal portion, and a second seal portion. The cleaning roller has a first rotation shaft and rotates while in contact with a rotating endless belt so as to collect waste toner from the endless belt. The collection roller has a second rotation shaft that extends in parallel to the first rotation shaft, and rotates while in contact with the cleaning roller so as to collect the waste toner from the cleaning roller. The blade rubs off the waste toner from the collection roller. The housing is fixed to a predetermined position, supports the second rotation shaft, and has a first space and a second space in an inside thereof, the first space storing the cleaning roller and the collection roller, the second space storing the waste toner that has been rubbed off from the collection roller by the blade. The pivot member is pivotably supported by the second rotation shaft, supports the first rotation shaft in a rotatable manner, and keeps a constant interval between the first rotation shaft and the second rotation shaft. The elastic member applies an elastic force to the cleaning roller so as to keep the cleaning roller at a position where the cleaning roller is in contact with the endless belt. The first seal portion has a fixed part that is fixed to the pivot member, and is formed as a sheet that extends from the fixed part toward the collection roller, the first seal portion being in contact with an outer circumferential surface of the collection roller. The second seal portion has a first part and a second part. The first part is fixed to one of an inner surface of the housing and the pivot member. The second part is in contact with the other of the inner surface of the housing and the pivot member. The second seal portion is elastically deformed in response to pivoting of the pivot member. The blade, the first seal portion, and the second seal portion partition the housing into the first space and the second space.

An image forming apparatus according to another aspect of the present disclosure includes a plurality of image carriers, an endless belt, a pair of belt support rollers, and the belt cleaning device that removes waste toner from the endless belt. The plurality of image carriers rotate while carrying toner images of different colors on outer circumferential surfaces thereof, respectively. To the endless belt, the toner images are transferred from the plurality of image carriers. The pair of belt support rollers support and rotate the endless belt.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It should be noted that the following embodiments are examples of specific embodiments of the present disclosure and should not limit the technical scope of the present disclosure.

[First Embodiment: Configuration of Image Forming Apparatus 10]

Figure 1:
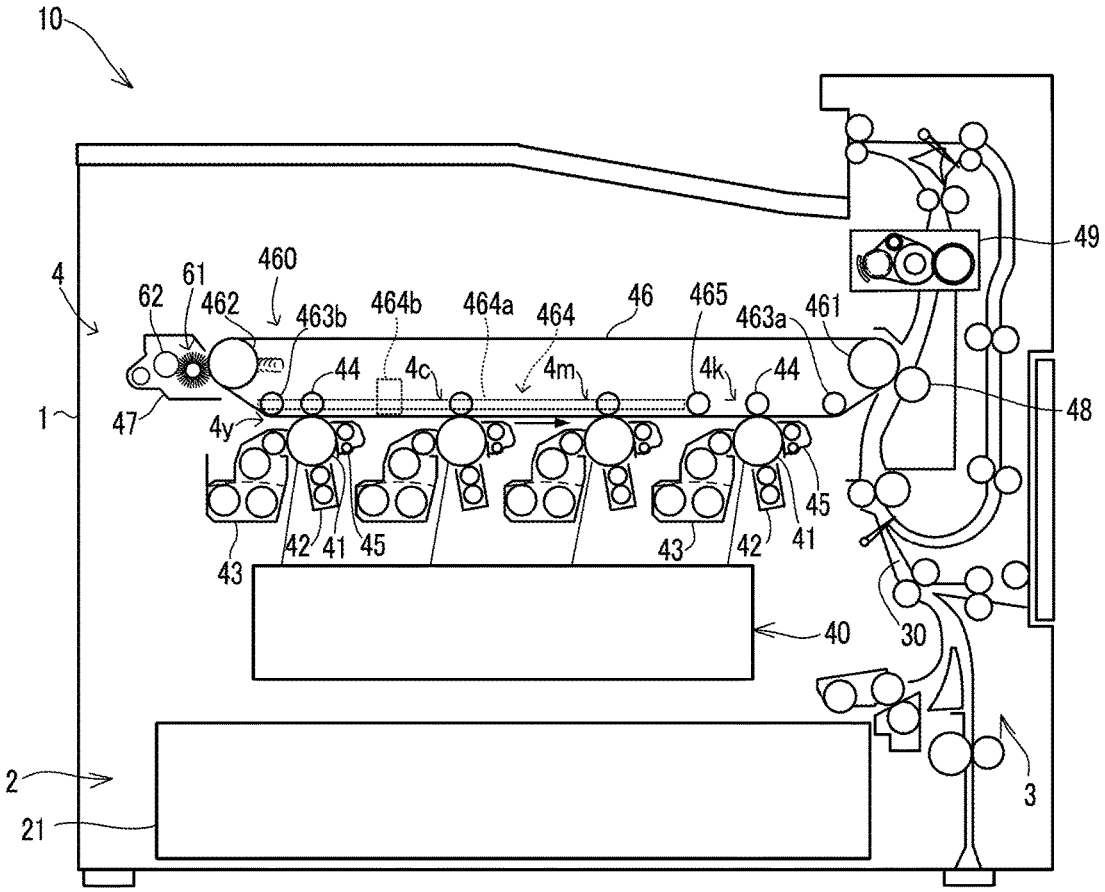
FIG. 1 is a configuration diagram of an image forming apparatus including a belt cleaning device according to a first embodiment of the present disclosure.

First, a description is given to a configuration of an image forming apparatus 10 including a belt cleaning device 47 according to a first embodiment, with reference to FIG. 1.

The image forming apparatus 10 forms a toner image on a sheet by an electrophotographic system. The sheet is a sheet-like image formation medium such as a sheet of paper or an envelope.

The image forming apparatus 10 includes, in a main body portion 1 thereof, a sheet supply portion 2, a sheet conveying portion 3, and an image forming portion 4. The image forming portion 4 executes an image forming process of forming a toner image on a sheet.

The image forming apparatus 10 is a tandem-type image forming apparatus, and is a color printer. Accordingly, the image forming portion 4 includes four image creating portions 4*y*, 4*c*, 4*m*, and 4*k*, an intermediate transfer belt 46, the belt cleaning device 47, and a sheet transfer device 48, wherein the four image creating portions 4*y*, 4*c*, 4*m*, and 4*k* respectively correspond to yellow, cyan, magenta, and black toner.

The image forming portion 4 further includes a laser scanning unit 40, a sheet transfer device 48, and a fixing device 49.

Each of the image creating portions 4*y*, 4*c*, 4*m*, and 4*k* includes a drum-like photoconductor 41, a charging device 42, a developing device 43, a belt transfer device 44, and a drum cleaning device 45. The four photoconductors 41 rotate while carrying toner images of different colors on their outer circumferential surfaces. It is noted that the photoconductor 41 is an example of the image carrier.

The sheet supply portion 2 feeds a sheet to a sheet conveyance path 30, and the sheet conveying portion 3 conveys the sheet along the sheet conveyance path 30.

In each of the image creating portions 4*y*, 4*c*, 4*m*, and 4*k*, the drum-like photoconductor 41 rotates, and the charging device 42 charges the surface of the photoconductor 41. Furthermore, the laser scanning unit 40 writes an electrostatic latent image on the surface of the photoconductor 41 by scanning a laser beam thereon.

In addition, the developing device 43 supplies the toner to the photoconductor 41 so as to develop the electrostatic latent image as a toner image. Subsequently, the belt transfer device 44 transfers the toner images from the surfaces of the photoconductors 41 to the intermediate transfer belt 46. With this operation, a color toner image composed of overlaid toner images of a plurality of colors is formed on the surface of the intermediate transfer belt 46.

The intermediate transfer belt 46 is an endless belt, namely an annular belt onto which the toner images are transferred from the four photoconductors 41. For example, the intermediate transfer belt 46 may be made of synthetic resin whose main component is polyimide, polyvinylidene fluoride, or polycarbonate.

The intermediate transfer belt 46 is stretched over a pair of belt support rollers 461 and 462, and in that state, is rotated by a rotational force received from one of the pair of belt support rollers 461 and 462. Furthermore, a pair of tension rollers 463*a* and 463*b* support the intermediate transfer belt 46 from inside thereof at positions close to the pair of belt support rollers 461 and 462, respectively. With this configuration, the pair of tension rollers 463*a* and 463*b* apply tension to the intermediate transfer belt 46.

The intermediate transfer belt 46 carries the toner images transferred from the four photoconductors 41 to a transfer position where it comes into contact with the sheet. The transfer position is a position of the intermediate transfer belt 46 that faces the sheet transfer device 48.

The pair of belt support rollers 461 and 462 are arranged at the transfer position and a position apart from the transfer position. In the following description, one of the pair of belt support rollers 461 and 462 that is arranged at the transfer position is referred to as a first support roller 461, and the other is referred to as a second support roller 462.

In addition, one of the pair of tension rollers 463*a* and 463*b* that is located close to the first support roller 461 is referred to as a first tension roller 463*a*, and the other that is close to the second support roller 462 is referred to as a second tension roller 463*b*.

Furthermore, a belt auxiliary roller 465 is arranged to be in contact with the inner side of the intermediate transfer belt 46 at a position between the image creating portion 4*k* for black toner and the image creating portions 4*y*, 4*c*, and 4*m* for the other three colors. The image creating portion 4*k* for black toner is arranged at the farthest position from the belt cleaning device 47 among the four image creating portions 4*y*, 4*c*, 4*m*, and 4*k*.

The first support roller 461 is rotated by a driving force received from a motor (not shown), and rotates the intermediate transfer belt 46. The second support roller 462 is driven-rotated. That is, the pair of belt support rollers 461 and 462 support and rotate the intermediate transfer belt 46.

The drum cleaning device 45 removes toner that has remained on the surface of the photoconductor 41 after the toner image was transferred to the intermediate transfer belt 46.

The sheet transfer device 48 transfers the color toner image carried by the intermediate transfer belt 46, to the sheet. The fixing device 49 heats the color toner image transferred to the sheet so that the color toner image is fixed to the sheet.

The belt cleaning device 47 removes waste toner that has remained on the intermediate transfer belt 46 after the color toner image was transferred to the sheet. The belt cleaning device 47 removes the waste toner from a portion of the intermediate transfer belt 46 that is supported by the second support roller 462.

The intermediate transfer belt 46, the pair of belt support rollers 461 and 462, the pair of tension rollers 463*a* and 463*b*, the belt auxiliary roller 465, and the four belt transfer devices 44 are unitized as an intermediate transfer unit 460.

In addition, the intermediate transfer unit 460 includes a belt deforming mechanism 464 that is configured to deform the intermediate transfer belt 46. The belt deforming mechanism 464 deforms the intermediate transfer belt 46 to a color image transfer shape and a monochrome image transfer shape, wherein in the color image transfer shape, the intermediate transfer belt 46 is in contact with all the four photoconductors 41, and in the monochrome image transfer shape, the intermediate transfer belt 46 is in contact with only one photoconductor 41 that carries a black toner image.

Figure 2:
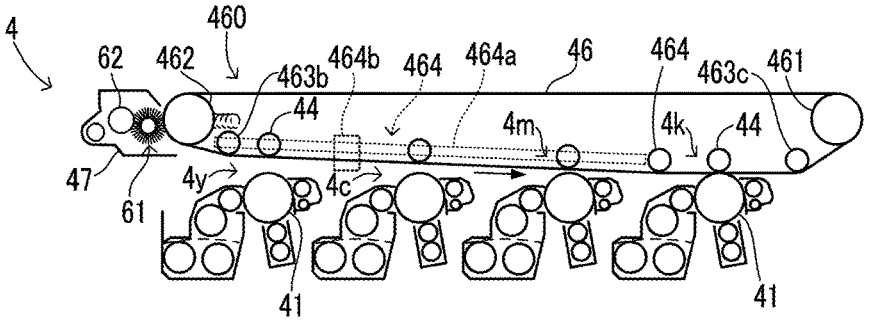
FIG. 2 is a configuration diagram of an image forming portion including an intermediate transfer unit that is in a monochrome transfer state.

FIG. 1 shows the intermediate transfer belt 46 in the color image transfer shape, and FIG. 2 shows the intermediate transfer belt 46 in the monochrome image transfer shape.

In the present embodiment, the belt deforming mechanism 464 includes a movable frame 464*a* and a frame displaceable mechanism 464*b*. The movable frame 464*a* integrally supports the second tension roller 463*b* and three belt transfer devices 44 that transfer toner images of yellow, cyan and magenta to the intermediate transfer belt 46.

The movable frame 464*a* is supported in such a way as to approach and separate from the three photoconductors 41 that carry toner images of yellow, cyan and magenta.

The frame displaceable mechanism 464*b* displaces the movable frame 464*a* between a reference position and a retreat position. FIG. 1 shows the movable frame 464*a* that is disposed at the reference position, and FIG. 2 shows the movable frame 464*a* that is disposed at the retreat position.

As shown in FIG. 1, the intermediate transfer belt 46 is in the color image transfer shape when the frame displaceable mechanism 464*b* displaces the movable frame 464*a* to the reference position. As shown in FIG. 2, the intermediate transfer belt 46 is in the monochrome image transfer shape when the frame displaceable mechanism 464*b* displaces the movable frame 464*a* to the retreat position.

It is noted that even when the belt deforming mechanism 464 operates, the shape of a portion of the intermediate transfer belt 46 from the belt auxiliary roller 465 to the first support roller 461 does not change. In other words, the belt deforming mechanism 464 does not deform the portion from the belt auxiliary roller 465 to the first support roller 461.

Figure 3:
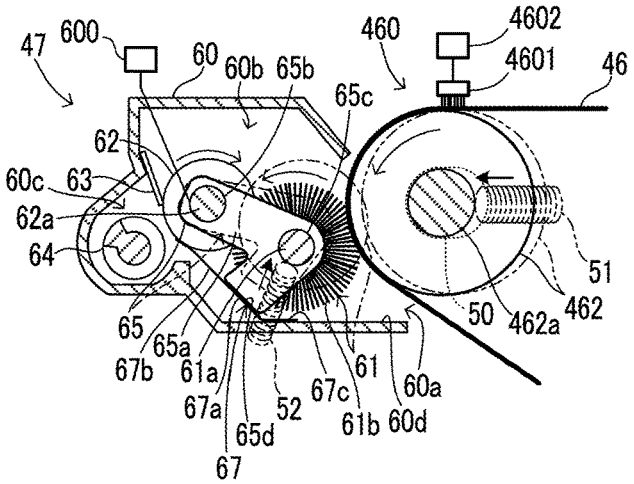
FIG. 3 is a configuration diagram of the belt cleaning device according to the first embodiment (in a case where the intermediate transfer unit is in the monochrome transfer state).

Furthermore, as shown in FIG. 3, the intermediate transfer unit 460 includes a slide support portion 50 and a first spring 51, wherein the slide support portion 50 supports a rotation shaft 462*a* of the second support roller 462, and the first spring 51 applies an elastic force to the rotation shaft 462*a* of the second support roller 462.

The slide support portion 50 supports the rotation shaft 462*a* such that the rotation shaft 462*a* is displaced in a direction to approach and separate from the belt cleaning device 47. The first spring 51 applies an elastic force to the rotation shaft 462*a* in a direction toward the belt cleaning device 47.

The second support roller 462 is supported by the slide support portion 50 and the first spring 51 so as to be displaced in response to a change of the intermediate transfer belt 46 in shape. It is noted that the second support roller 462 is an example of the displaceable roller that is supported so as to be displaced in response to change of the intermediate transfer belt 46 in shape.

In a case where the intermediate transfer belt 46 is in the monochrome image transfer shape, the belt deforming mechanism 464 holds the intermediate transfer belt 46 along a path that is closer to the slide support portion 50 than a path in a case where the intermediate transfer belt 46 is in the color image transfer shape.

Figure 4:
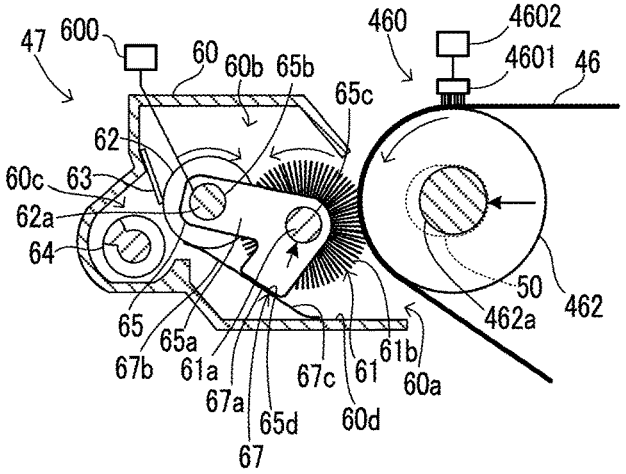
FIG. 4 is a configuration diagram of the belt cleaning device according to the first embodiment (in a case where the intermediate transfer unit is in a color transfer state).

Accordingly, when the intermediate transfer belt 46 changes from the color image transfer shape to the monochrome image transfer shape, the rotation shaft 462*a* of the second support roller 462 is displaced in a direction to separate from the first support roller 461, namely in a direction to approach the belt cleaning device 47. FIG. 4 shows the second support roller 462 that has approached the belt cleaning device 47.

On the other hand, when the intermediate transfer belt 46 changes from the monochrome image transfer shape to the color image transfer shape, the rotation shaft 462*a* of the second support roller 462 is displaced in a direction to approach the first support roller 461, namely in a direction to separate from the belt cleaning device 47. FIG. 3 shows the second support roller 462 that is separated from the belt cleaning device 47. It is noted that in FIG. 3, the second support roller 462 in a state where the intermediate transfer belt 46 is in the color image transfer shape, is represented by an imagenary line (a two-dot chain line).

[Outlined Configuration of Belt Cleaning Device 47]

As shown in FIG. 3 and FIG. 4, the belt cleaning device 47 includes a cleaning roller 61, a collection roller 62, a blade 63, a conveyance screw 64, and a housing 60. The housing 60 is a hollow member storing the cleaning roller 61, the collection roller 62, the blade 63, and the conveyance screw 64.

The housing 60 has an opening 60*a* that opens a position where the cleaning roller 61 comes into contact with the intermediate transfer belt 46.

The cleaning roller 61 includes a first rotation shaft 61*a* and rotates while in contact with the rotating intermediate transfer belt 46. This allows the cleaning roller 61 to collect the waste toner from the intermediate transfer belt 46.

In the present embodiment, the cleaning roller 61 is a brush roller that includes the first rotation shaft 61*a* and a plurality of bristles 61*b* that extend upward from the first rotation shaft 61*a*. The cleaning roller 61 rotates in the same direction as the rotation direction of the intermediate transfer belt 46. The cleaning roller 61 comes into contact with a part of the intermediate transfer belt 46 that is supported by the second support roller 462.

The collection roller 62 includes a second rotation shaft 62*a* that extends in parallel to the first rotation shaft 61*a*. The collection roller 62 rotates while in contact with the cleaning roller 61 and collects the waste toner from the cleaning roller 61. The collection roller 62 rotates in an opposite direction to the rotation direction of the cleaning roller 61.

In the following description, an original charging polarity of the toner is referred to as a normal charging polarity. In addition, an opposite polarity to the normal charging polarity is referred to as an opposite charging polarity. For example, the normal charging polarity may be plus, and the opposite charging polarity may be minus.

In the present embodiment, a charging brush 4601 to which a bias of the normal charging polarity has been applied by a first bias application circuit 4602, charges the waste toner on the intermediate transfer belt 46 to the normal charging polarity.

The charging brush 4601 and the first bias application circuit 4602 are provided in the intermediate transfer unit 460. It is noted that the second support roller 462 is grounded.

On the other hand, a bias of the opposite charging polarity is applied to the collection roller 62 by a second bias application portion 600. This allows the bias of the opposite charging polarity to be applied to the cleaning roller 61 from the second bias application portion 600 via the collection roller 62.

It is noted that to the collection roller 62 directly connected to the second bias application portion 600, a bias of the opposite charging polarity of a higher level than the cleaning roller 61 is applied.

Accordingly, the cleaning roller 61 collects the waste toner from the intermediate transfer belt 46 by electrically adsorbing the waste toner carried on the intermediate transfer belt 46. Furthermore, the collection roller 62 collects the waste toner from the cleaning roller 61 by electrically adsorbing the waste toner collected by the cleaning roller 61.

The blade 63 is fixed to the inner surface of the housing 60 in a state where its tip portion is in contact with the outer circumferential surface of the collection roller 62. The blade 63 rubs off the waste toner from the collection roller 62. The tip portion of the blade 63 is in contact with the outer circumferential surface of the collection roller 62 over the whole range in a direction along the second rotation shaft 62*a*.

The housing 60 is fixed to a position that faces the second support roller 462. For example, the housing 60 is fixed to a frame of the main body portion 1. The housing 60 includes a bearing (not shown) that rotatably supports the second rotation shaft 62*a*.

The conveyance screw 64 rotates in such a way as to convey the waste toner that has been rubbed off from the collection roller 62 by the blade 63. The conveyance screw 64 conveys the waste toner to a toner discharge port (not shown) formed in the housing 60.

The toner discharge port communicates with an inside of a waste toner box (not shown). The conveyance screw 64 discharges the waste toner from the inside of the housing 60 through the toner discharge port. This allows the waste toner to be collected in the waste toner box.

It is noted that a driving mechanism (not shown) including a motor and a gear rotates the first rotation shaft 61*a*, the second rotation shaft 62*a*, and the conveyance screw 64.

Furthermore, the belt cleaning device 47 includes a sheet-like seal member 67 that prevents the waste toner from leaking from the housing 60. The seal member 67 is formed from a flexible sheet. The seal member 67 is, for example, a film made of synthetic resin whose main component is polyethylene terephthalate. Details of the seal member 67 of the present embodiment are described below.

It is noted that in some conventional devices, the seal member 67 is attached to an edge portion of the opening 60*a* of the housing 60. In that case, the seal member 67 comes into contact with the intermediate transfer belt 46 and closes a gap between the housing 60 and the intermediate transfer belt 46.

Meanwhile, in the present embodiment, the cleaning roller 61 of the belt cleaning device 47 comes into contact with a part of the intermediate transfer belt 46 that is supported by the second support roller 462. As described above, the second support roller 462 is displaced in response to a change of the intermediate transfer belt 46 in shape.

If the seal member 67 was attached to an edge portion of the opening 60*a* of the housing 60 as in some conventional devices, the seal member 67 would not be able to follow a displacement of the second support roller 462 and keep a state in which the gap between the housing 60 and the intermediate transfer belt 46 is closed.

On the other hand, if it was possible to adopt a mechanism that causes the housing 60 to move in conjunction with the displacement of the second support roller 462, the seal member 67 would be able to close the gap between the housing 60 and the intermediate transfer belt 46 even when the second support roller 462 was displaced. However, it is preferable not to adopt such a large-scale mechanism.

The belt cleaning device 47 has a structure that, with a relatively simple mechanism, prevents the collected waste toner from leaking from the inside of the housing 60. The following describes the structure.

[Detailed Structure of Belt Cleaning Device 47]

The belt cleaning device 47 further includes a pivot member 65 and a second spring 52. The pivot member 65 is provided in the inside of the housing 60 together with the cleaning roller 61 and the collection roller 62. It is noted that in FIG. 4, the first spring 51 and the second spring 52 are omitted.

The pivot member 65 is pivotably supported by the second rotation shaft 62*a*, while supporting the first rotation shaft 61*a* in a rotatable manner. The pivot member 65 keeps a constant interval between the first rotation shaft 61*a* and the second rotation shaft 62*a*.

Figure 5:
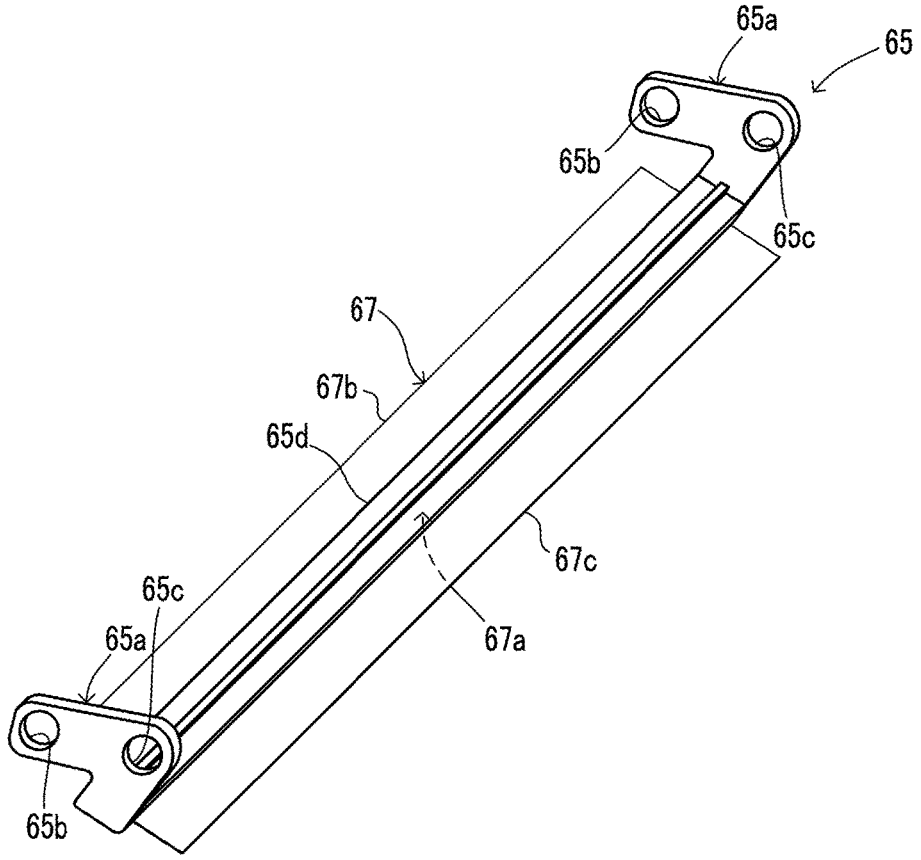
FIG. 5 is a perspective diagram of a pivot member included in the belt cleaning device according to the first embodiment.

As shown in FIG. 3 and FIG. 5, the pivot member 65 includes a pair of shaft interval maintaining portions 65*a* and a connecting portion 65*d* that connects the pair of shaft interval maintaining portions 65*a* with each other. The connecting portion 65*d* is formed to extend in parallel to the first rotation shaft 61*a*.

The pair of shaft interval maintaining portions 65*a* are respectively located proximate to opposite ends of the first rotation shaft 61*a* and the second rotation shaft 62*a*. Each of the pair of shaft interval maintaining portions 65*a* includes a supported portion 65*b* and a bearing portion 65*c*.

The supported portion 65*b* is rotatably supported by the second rotation shaft 62*a*. In the present embodiment, each of the supported portions 65*b* has a hole in which an end portion of the second rotation shaft 62*a* is inserted.

The bearing portion 65*c* rotatably supports the first rotation shaft 61*a*. In the present embodiment, each of the bearing portions 65*c* has a hole in which an end portion of the first rotation shaft 61*a* is inserted. The pair of shaft interval maintaining portions 65*a* maintain a constant interval between the first rotation shaft 61*a* and the second rotation shaft 62*a*.

In a state where the cleaning roller 61 is supported by the pair of shaft interval maintaining portions 65*a*, the cleaning roller 61 can pivot around the second rotation shaft 62*a*.

In FIG. 3, the second spring 52 is represented by an imaginary line. It is noted that the first spring 51 and the second spring 52 are omitted in FIG. 4.

The second spring 52 applies an elastic force to the first rotation shaft 61*a* of the cleaning roller 61 so as to keep the cleaning roller 61 at a position where it is in contact with the intermediate transfer belt 46. The second spring 52 is an example of the elastic member that applies an elastic force to the cleaning roller 61.

Figure 6:
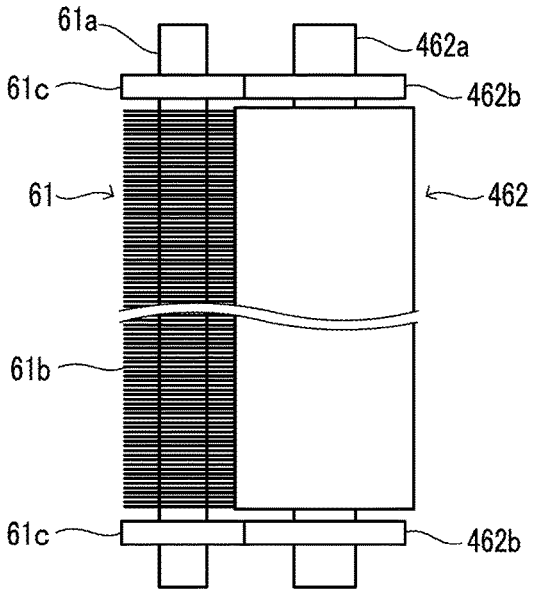
FIG. 6 is a plan diagram of a displaceable roller of the intermediate transfer unit and a brush roller of the belt cleaning device according to the first embodiment.

As shown in FIG. 6, a pair of first spacers 61*c* are attached to the first rotation shaft 61*a* at positions close to opposite ends thereof. Similarly, a pair of second spacers 462*b* are attached to the rotation shaft 462*a* of the second support roller 462 at positions close to opposite ends thereof.

When the intermediate transfer belt 46 changes its shape between the color image transfer shape and the monochrome image transfer shape, the pivot member 65 pivots in response to a displacement of the rotation shaft 462*a* of the second support roller 462.

The second spring 52 applies the elastic force to the first rotation shaft 61*a*, thereby maintaining a state where the pair of first spacers 61*c* are in contact with the pair of second spacers 462*b*. That is, the force of the second spring 52 allows the first rotation shaft 61*a* to be displaced in conjunction with a displacement of the rotation shaft 462*a* of the second support roller 462.

With the above-described configuration, a constant interval between the first rotation shaft 61*a* and the rotation shaft 462*a* of the second support roller 462 is maintained. As a result, even when the second support roller 462 is displaced, the elastic force of the second spring 52 keeps the cleaning roller 61 at a position where it is in contact with the intermediate transfer belt 46.

The housing 60 has a first space 60*b* and a second space 60*c* in its inside. The first space 60*b* stores the cleaning roller 61, the collection roller 62, and the pivot member 65. The second space 60*c* stores waste toner that has been rubbed off from the collection roller 62 by the blade 63. The conveyance screw 64 is arranged in the second space 60*c*.

The intermediate portion of the seal member 67 is a fixed portion 67*a* that is fixed to the connecting portion 65*d* of the pivot member 65. For example, the fixed portion 67*a* is fixed to the connecting portion 65*d* by an adhesive.

In the seal member 67, a portion from the fixed portion 67*a* to a first edge portion forms a first seal portion 67*b*, and a portion from the fixed portion 67*a* to a second edge portion forms a second seal portion 67*c*. The first edge portion and the second edge portion of the seal member 67 are opposite to each other. The fixed portion 67*a* constitutes a part of the first seal portion 67*b*, and constitutes a part of the second seal portion 67*c*. It is noted that FIG. 5 shows the pivot member 65 to which the seal member 67 has been attached.

The first seal portion 67*b* is formed as a sheet that extends from the fixed portion 67*a* fixed to the connecting portion 65*d*, toward the collection roller 62. The first seal portion 67*b* is in contact with the outer circumferential surface of the collection roller 62 over the whole range in a direction along the second rotation shaft 62*a*.

The second seal portion 67*c* is formed as a sheet that extends from the fixed portion 67*a* fixed to the connecting portion 65*d*, toward an inner bottom surface 60*d* of the housing 60. The second seal portion 67*c* is in contact with the inner bottom surface 60*d* over the whole range in a direction along the first rotation shaft 61*a*. In the second seal portion 67*c* of the present embodiment, the fixed portion 67*a* corresponds to the first part, and a part that is in contact with the inner bottom surface 60*d* corresponds to the second part.

The second seal portion 67*c* is elastically deformed in response to the pivoting of the pivot member 65. With this configuration, even when the intermediate transfer belt 46 changes its shape between the color image transfer shape and the monochrome image transfer shape, and the pivot member 65 pivots, the second seal portion 67*c* is kept to be in contact with the inner bottom surface 60*d* of the housing 60. It is noted that in FIG. 3, the pivot member 65 in a state where the intermediate transfer belt 46 is in the color image transfer shape, is represented by an imaginary line.

The blade 63, the first seal portion 67*b*, and the second seal portion 67*c* partition the housing 60 into the first space 60*b* and the second space 60*c*. This prevents the waste toner that has been rubbed off from the collection roller 62 by the blade 63, from leaking out from the housing 60.

In addition, the intermediate transfer belt 46 slightly vibrates while it is operating, and the pivot member 65 and the cleaning roller 61 that moves in conjunction with the second support roller 462, slightly vibrate. As a result, the seal member 67 attached to the pivot member 65 also vibrates. This prevents powder such as paper dust from adhering to the seal member 67.

In addition, the belt cleaning device 47 can be realized by adopting a relatively simple mechanism, without adopting a large-scale mechanism that displaces the whole housing 60.

In addition, a sheet of the seal member 67 that is fixed to the pivot member in part includes the first seal portion 67*b* and the second seal portion 67*c*. As a result, the number of parts does not increase.

[Second Embodiment]

Figure 7:
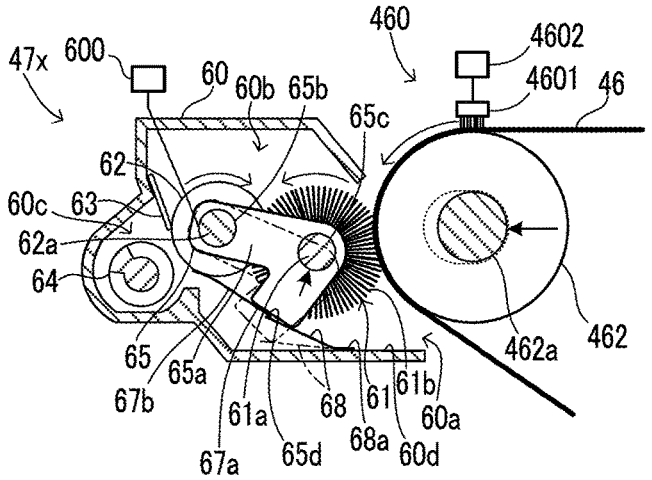
FIG. 7 is a configuration diagram of a belt cleaning device according to a second embodiment.

Next, a belt cleaning device 47*x* according to a second embodiment is described with reference to FIG. 7. In FIG. 7, components that are the same as those shown in FIG. 3 and FIG. 4 are assigned the same reference signs.

The following describes differences between the belt cleaning device 47*x* and the belt cleaning device 47. It is noted that the first spring 51 and the second spring 52 are omitted in FIG. 7.

The belt cleaning device 47*x* does not include the seal member 67 of the belt cleaning device 47, but includes a second seal portion 68, and the first seal portion 67*b* includes the fixed portion 67*a*. The first seal portion 67*b* and the second seal portion 68 are individual flexible sheets.

A part of the second seal portion 68 is a fixed portion 68*a* fixed to the inner bottom surface 60*d* of the housing 60. Another part of the second seal portion 68 extends from the fixed portion 68*a* toward the connecting portion 65*d* of the pivot member 65 and is in contact with the connecting portion 65*d*. In the second seal portion 68 of the present embodiment, the fixed portion 68*a* corresponds to the first part, and a part that is in contact with the connecting portion 65*d* corresponds to the second part.

The second seal portion 68 is in contact with the connecting portion 65*d* of the pivot member 65 over the whole range in a direction along the first rotation shaft 61*a*. The second seal portion 68 is elastically deformed in response to the pivoting of the pivot member 65. In FIG. 7, the pivot member 65 and the second seal portion 68 in a case where the intermediate transfer belt 46 is in the monochrome image transfer shape, are represented by imaginary lines.

The blade 63, the first seal portion 67*b*, and the second seal portion 68 partition the housing 60 into the first space 60*b* and the second space 60*c*.

The belt cleaning device 47*x* produces the same effects as the belt cleaning device 47.

[Application Examples]

In the belt cleaning device 47*x*, the second seal portion 68 may be a foam member that fills in the gap between the connecting portion 65*d* of the pivot member 65 and the inner bottom surface 60*d* of the housing 60. In this case, a lower surface of the foam member may be fixed to the inner bottom surface 60*d* of the housing 60 in a state where an upper surface of the foam member is in contact with the connecting portion 65*d*. Conversely, the upper surface of the foam member may be fixed to the connecting portion 65*d* in a state where the lower surface of the foam member is in contact with the inner bottom surface 60*d*.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A belt cleaning device comprising:

a cleaning roller having a first rotation shaft and configured to rotate while in contact with a rotating endless belt so as to collect waste toner from the endless belt;

a collection roller having a second rotation shaft that extends in parallel to the first rotation shaft, and configured to rotate while in contact with the cleaning roller so as to collect the waste toner from the cleaning roller;

a blade configured to rub off the waste toner from the collection roller;

a housing fixed to a predetermined position, supporting the second rotation shaft, and having a first space and a second space in an inside thereof, the first space storing the cleaning roller and the collection roller, the second space storing the waste toner that has been rubbed off from the collection roller by the blade;

a pivot member pivotably supported by the second rotation shaft, supporting the first rotation shaft in a rotatable manner, and configured to keep a constant interval between the first rotation shaft and the second rotation shaft;

an elastic member configured to apply an elastic force to the cleaning roller so as to keep the cleaning roller at a position where the cleaning roller is in contact with the endless belt;

a first seal portion having a fixed part that is fixed to the pivot member, and formed as a sheet that extends from the fixed part toward the collection roller, the first seal portion being in contact with an outer circumferential surface of the collection roller; and a second seal portion having a first part and a second part, the first part being fixed to one of an inner surface of the housing and the pivot member, the second part being in contact with the other of the inner surface of the housing and the pivot member, the second seal portion being elastically deformed in response to pivoting of the pivot member, wherein the blade, the first seal portion, and the second seal portion partition the housing into the first space and the second space.

2. The belt cleaning device according to claim 1, wherein a flexible sheet partially fixed to the pivot member includes the first seal portion and the second seal portion.

3. The belt cleaning device according to claim 1, wherein the pivot member includes:

a pair of shaft interval maintaining portions respectively located proximate to opposite ends of the first rotation shaft and the second rotation shaft, each of the pair of shaft interval maintaining portions including a supported portion and a bearing portion, the supported portion being rotatably supported by the second rotation shaft, the bearing portion rotatably supporting the first rotation shaft, the pair of shaft interval maintaining portions keeping the constant interval between the first rotation shaft and the second rotation shaft; and a connecting portion configured to connect the pair of shaft interval maintaining portions with each other, a part of the first seal portion is fixed to the connecting portion, and a part of the second seal portion is fixed to one of the inner surface of the housing and the connecting portion, and another part of the second seal portion is fixed to the other of the inner surface of the housing and the connecting portion.

4. An image forming apparatus comprising:

a plurality of image carriers configured to rotate while carrying toner images of different colors on outer circumferential surfaces thereof, respectively;

an endless belt to which the toner images are transferred from the plurality of image carriers;

a pair of belt support rollers configured to support and rotate the endless belt; and the belt cleaning device according to claim 1 configured to remove waste toner from the endless belt.

5. The image forming apparatus according to claim 4, further comprising:

a belt deforming mechanism configured to deform the endless belt to a color image transfer shape and a monochrome image transfer shape, wherein in the color image transfer shape, the endless belt is in contact with all of the plurality of image carriers, and in the monochrome image transfer shape, the endless belt is in contact with only one of the plurality of image carriers that carries a black toner image, wherein one of the pair of belt support rollers is a displaceable roller that is supported so as to be displaced in response to change of the endless belt in shape, and the cleaning roller of the belt cleaning device comes into contact with a part of the endless belt that is supported by the displaceable roller.

* * * * *